US007785681B2

(12) United States Patent
Liao

(10) Patent No.: US 7,785,681 B2
(45) Date of Patent: Aug. 31, 2010

(54) ELONGATE LAMINATED WOODEN HANDLES AND METHOD OF MANUFACTURING SAME

(76) Inventor: Dick Liao, 365 Oak St., Bridgewater, MA (US) 02324-1530

( * ) Notice: Subject to any disclaimer, the term of this patent is extended or adjusted under 35 U.S.C. 154(b) by 983 days.

(21) Appl. No.: 11/166,992

(22) Filed: Jun. 24, 2005

(65) Prior Publication Data

US 2007/0009678 A1 Jan. 11, 2007

(51) Int. Cl.

| | |
|---|---|
| ***B27M 3/16*** | (2006.01) |
| ***B27M 1/08*** | (2006.01) |
| ***B27M 3/28*** | (2006.01) |
| ***B27G 11/00*** | (2006.01) |
| ***B27K 3/08*** | (2006.01) |
| ***B27L 9/00*** | (2006.01) |

(52) U.S. Cl. ..... 428/35.6; 428/541; 473/564; 473/559; 473/316; 473/318; 15/119.1; 15/117; 15/143.1; 56/400.01; 16/110.1; 16/111.1; 144/333; 144/346; 144/348; 144/349; 144/355

(58) Field of Classification Search ..... None
See application file for complete search history.

(56) References Cited

U.S. PATENT DOCUMENTS

| | | | | |
|---|---|---|---|---|
| 422,470 | A * | 3/1890 | Varney | 43/18.1 R |
| 1,589,297 | A * | 6/1926 | Lard | 473/309 |
| 1,932,986 | A * | 10/1933 | Powell | 43/18.1 R |
| 2,352,740 | A * | 7/1944 | Shannon | 427/308 |
| 4,774,906 | A | 10/1988 | Lu | |
| 5,433,805 | A * | 7/1995 | Schmidmeier | 156/84 |
| 5,743,809 | A * | 4/1998 | Lehman | 473/300 |
| 5,876,649 | A | 3/1999 | Ryan | |
| 6,576,331 | B1 | 6/2003 | Ryan | |
| 6,767,299 | B1 * | 7/2004 | Chang | 473/564 |
| 6,827,659 | B1 * | 12/2004 | Chen | 473/564 |
| 2004/0029660 | A1 * | 2/2004 | Chen et al. | 473/564 |

* cited by examiner

*Primary Examiner*—Jennifer A Chriss
(74) *Attorney, Agent, or Firm*—Pandiscio & Pandiscio

(57) ABSTRACT

A method of manufacturing elongate wooden handles for floor mops and the like comprises (a) splitting a green bamboo cane lengthwise and then spreading it into the shape of a sheet, (b) planing both surfaces of the sheet to give it a substantially uniform thickness, (c) cutting the bamboo sheet into an elongate section of selected width, (d) drying that bamboo section, (e) providing an assembly comprising a pair of dowels, at least one elongate core member, said bamboo sections and an adhesive, with the bamboo section wrapped around the dowels and the core member and the adhesive disposed between the bamboo section and the dowels and core member, (f) heating that assembly under pressure so the adhesive will bond the dowels and core member to the surrounding bamboo section and thereby form an elongate pole, and (g) turning the elongate pole to a selected outer diameter.

9 Claims, 4 Drawing Sheets

ELONGATE LAMINATED WOODEN HANDLES AND METHOD OF MANUFACTURING SAME

BACKGROUND OF THE INVENTION

1. Field of the Invention

This invention relates to the manufacture of elongate wooden handles for floor mops, brushes, rakes and the like and more particularly to handles made of laminated pieces of bamboo.

2. Description of the Prior Art

A number of implements such as floor mops, brushes, rakes and the like commonly have wooden handles in the form of elongate poles. In some cases the handles are solid, one-piece poles of a selected hard wood, e.g., maple. In other cases they are poles comprised of multiple pieces of bamboo laminated together. Such laminated structures are made by converting green bamboo cane into long dried strips which have a generally trapezoidal shape in cross-section (the green bamboo cane may be dried before or after it is cut into strips), and then assembling a number of such strips (usually four strips) around a number of wooden plugs of square cross-sectional shape (usually three plugs) to form a hollow tube. The plugs are usually made of a hard wood, e.g., maple or oak. One of the wooden plugs is located at each end of the tube and the third is located approximately equidistant from the other two plugs. The strips are coated with an adhesive and the assembled strips and plugs are laminated together under heat and pressure to form a stiff laminated pole. After lamination the resulting elongate pole is turned, e.g., on a lathe, to a suitable diameter and one end is processed to provide it with a taper or a screw thread whereby that end may be mated with a brush, mop or rake head. Such laminated handles have competed successfully with one piece sold wood handles. However, the foregoing lamination method suffers from the fact that a substantial amount of bamboo is discarded as waste in forming the elongate trapezoidally shaped strips and considerable labor is involved in converting the bamboo cane into laminated poles.

OBJECTS AND SUMMARY OF THE INVENTION

A primary object of the present invention is to provide an improved method of manufacturing laminated handle from bamboo cane.

Another primary object of the present invention is to provide laminated bamboo handles for mops, rakes, and like utensils or implements that are characterized by a novel construction and which can be made with less labor than prior known laminated bamboo handles.

A further object is to provide a method of making laminated wooden handles that requires less labor and produces less bamboo waste than the prior known method of making laminated bamboo handles.

In the preferred embodiment of the invention, the foregoing objects are achieved by (a) splitting green bamboo canes lengthwise along a single cut line and then spreading the split bamboo canes into the shape of flat sheets, (b) planing the opposite sides of each sheet using a power planer so as to give it a substantially uniform thickness, (c) if a bamboo sheet is too wide for the purposes of this invention, cutting the bamboo sheet into two or more elongate sections of selected width, (d) drying the elongate bamboo sections, (e) providing separate assemblies each comprising a pair of dowels, at least one elongate core member, one of said bamboo sections and an adhesive, with the bamboo section wrapped around the dowels and the at least one core member and the adhesive disposed between the bamboo section and the dowels and core member, (f) subjecting each of said assemblies to heat and pressure so as to cause the adhesive to set and bond the dowels and core member to the surrounding bamboo section and thereby form an elongate pole, and (g) turning the elongate pole to a selected outer diameter.

DETAILED DESCRIPTION OF THE PREFERRED EMBODIMENT

Figure 2:
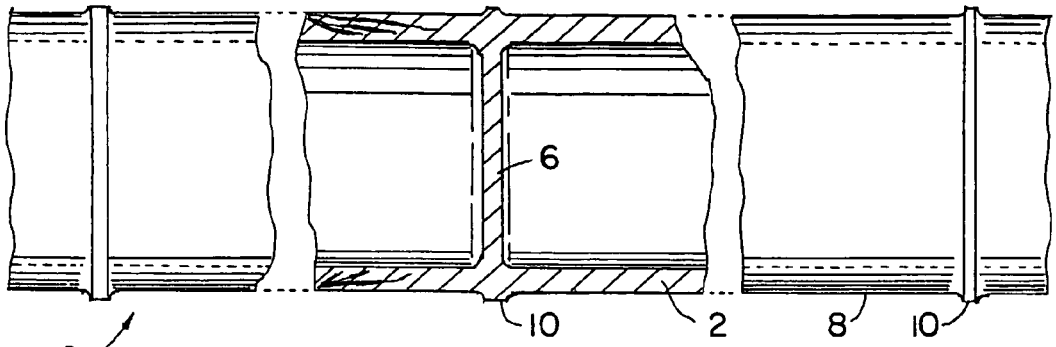
FIG. 2 is a fragmentary elevational view, partly in section, of a green bamboo cane.

Referring first to FIG. 2, green bamboo cane 2 is characterized by a generally cylindrical side wall 4, with its interior being subdivided by multiple partitions 6 and its exterior surface 8 having circumferentially-extending ribs 10 at the locations of the internal partitions. Green bamboo cane is harvested in various sizes and lengths. By way of example but not limitation, the cane may have an outside diameter of in the range of about 8 to about 12 cm and a wall thickness in the range of about 6 to about 12 mm, with the partitions 6 spaced apart a distance in the range of about 18 to about 25 cm and the ribs 10 protruding in the range of about 7 to about 8 mm from exterior surface 8.

Figure 1:
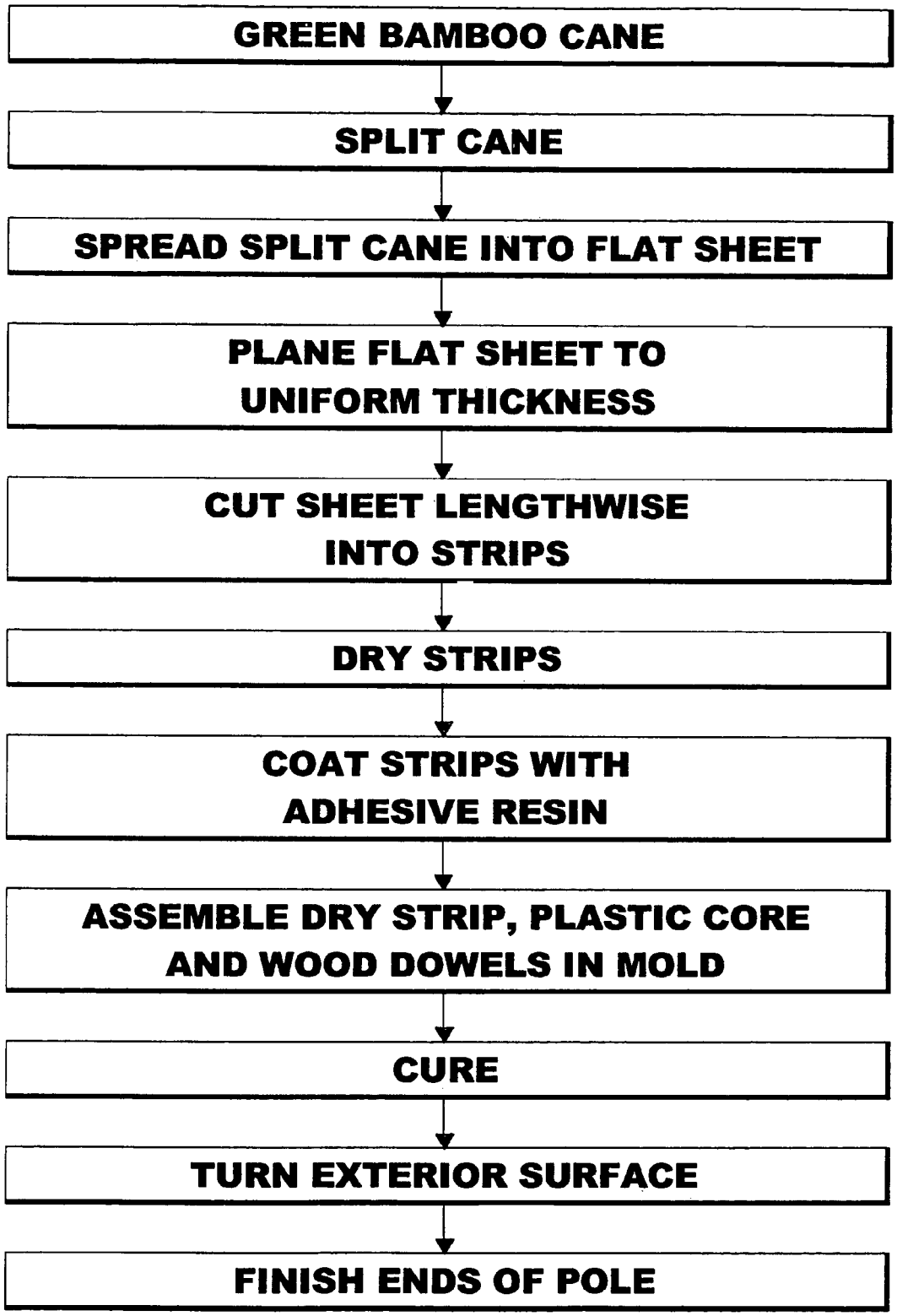
FIG. 1 is a flow diagram of the novel method of this invention.
Figure 3:
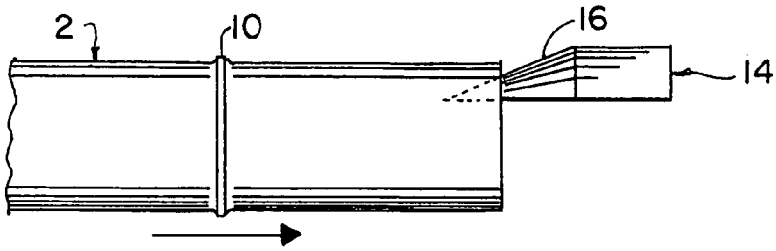
FIG. 3 is a fragmentary view in elevation illustrating how splitting of a bamboo cane is initiated.

According to the method of this invention and as indicated in FIG. 1, each length of green bamboo cane is split longitudinally and spread into a flat sheet. As illustrated in FIG. 3, splitting of the green bamboo cane is preferably accomplished by forcing the cane to move axially into engagement with a fixed, i.e., stationary, cutting blade 14 that has an inclined cutting edge 16, causing the blade to split the cane lengthwise end to end. Preferably but not necessarily the leading (upstream) end of the cutting blade may terminate in a point as shown in phantom in FIG. 3. Axial movement of the cane is accomplished by a suitable transport mechanism (not shown). By way of example but not limitation, axial movement of the cane may be accomplished by a pusher device exerting a pushing force on the trailing end of the cane. Cutting blade 14 is sized and positioned so that the inside surface of the leading end of the cane will engage cutting edge 16 downstream of its pointed end (as shown in FIG. 3) and the cane is transported axially with enough force, e.g., about 30 kgs, to produce the cutting action required to split it lengthwise end to end. Preferably cutting blade 14 is sized so as to extend radially inward of the cane far enough to intercept and rupture each of the partitions 6 in turn as the cane moves axially along and past the cutting blade.

Figure 4A:
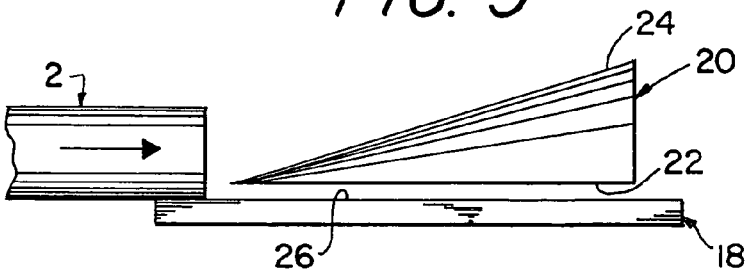
FIGS. 4A and 4B are fragmentary side elevation and plan views illustrating the tools used to spread the split cane into a flat sheet.
Figure 4B:
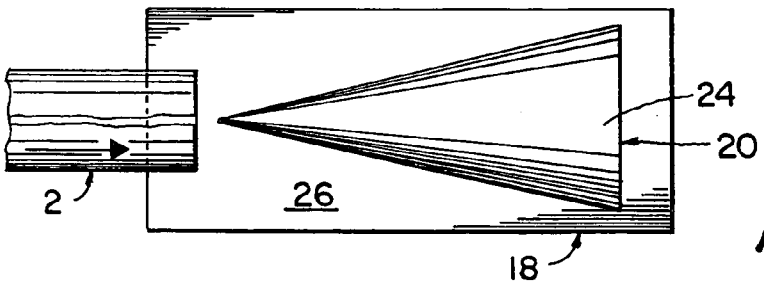

The split bamboo cane is transported downstream of knife blade 14 (by the same or a different transport mechanism) into encountering relation with a fixed spreading and flattening mechanism (FIGS. 4*a* and 4*b*) that comprises a flat rigid bed 18 and an expander mandrel 20 that is fixed and located close to but spaced from bed 18. Bed 18 and mandrel 20 are aligned with the longitudinal axis of the moving cane and are supported by suit able means (not shown). The expander mandrel 20 comprises a bottom surface 22 that is flat and wedge-shaped and extends parallel to bed 18, and a top surface 24 that is conically shaped, i.e., is a section of a cone. Preferably the front (upstream) end of the expander mandrel is pointed when viewed from above as illustrated in FIG. 4*b*. However, that front end of the mandrel need not be pointed so long as it is small enough to fit within the leading end of the bamboo cane.

The spacing or gap between expander mandrel 20 and the flat top surface 26 of bed 18 is close to but exceeds the wall thickness of the bamboo cane by several mm. Preferably and as shown in FIGS. 4*a* and 4*b*, the expander mandrel is located so that its front end is slightly downstream of the front (upstream) end of bed 18. Preferably also the spreading and flattening mechanism is located immediately adjacent to the cutting blade 14 so it will intercept the leading end of the bamboo cane while a trailing portion of the cane is still engaged with the knife blade 14. Alternatively, the spreading and flattening mechanism could be spaced away from the cutting blade so that each bamboo cane would be completely split lengthwise before being brought into contact with the spreading and flattening mechanism.

Still referring to FIGS. 4*a* and 4*b*, as the moving cane moves lengthwise relative to the spreading and flattening mechanism, a portion of its leading end passes between the flat bottom surface of mandrel 20 and the top surface of bed 18 and the front (upstream) end of the mandrel intrudes into the interior space of the cane. Then as the cane continues to move axially in a downstream direction relative to and in continuing engagement with mandrel 20 and bed 18, the mandrel will exert a radially outward force on its inner surface, causing the split in the cane to expand. The expansion of the cane increases with its continued downstream movement relative to the mandrel, with the result that the wedge-shaped side edges of the bottom surface 22 of the mandrel causes it to spread out flat against the top surface of bed 18.

Figure 5:
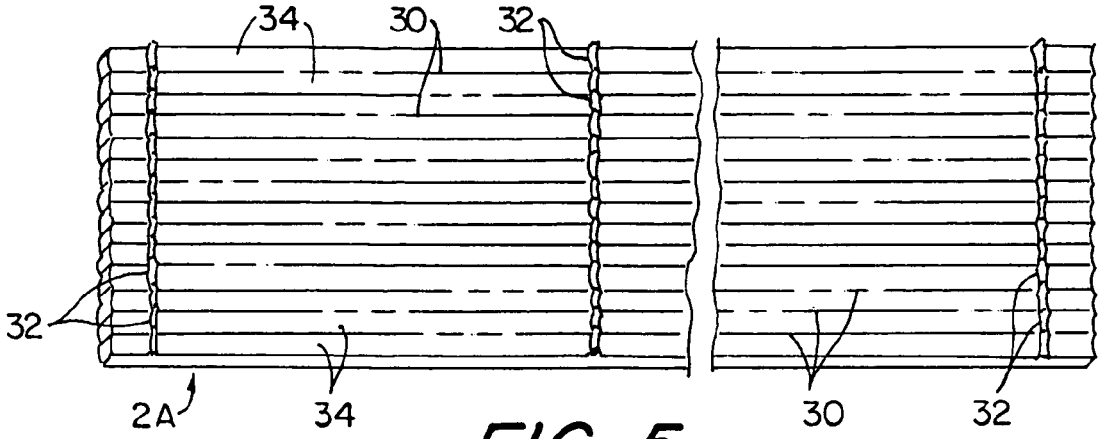
FIG. 5 illustrates the flat sheet formed by splitting and spreading the bamboo cane.

The bottom surface 22 of the mandrel and the bed 18 have a maximum width (their vertical dimension in FIG. 4*b*) that is at least equal to the magnitude of the circumference of the cane's inner surface, with the result that each portion of the cane that reaches the downstream (rear) end of the mandrel will have been rendered flat. Additionally because of the close spacing between them, the top surface of the bed and the bottom surface of the mandrel coact to shear off most of the ruptured partitions as the cane moves between them. Consequently when the entire cane has passed through the spreading and flattening mechanism it will have been converted into a flat sheet 2A that, as shown in FIG. 5, is characterized by longitudinally-extending partial fractures as represented schematically by the broken lines 30 and by crosswise-extending lines of small projecting remnants 32 of partitions 6. The fractures are partial in the sense that they are discontinuous lengthwise and/or depthwise (the depth is measured along the thickness dimension of the sheet), so that the adjacent portions 34 of the bamboo that are demarcated by the fractures as represented by broken lines 30 remain connected to each other by fibrous strands of bamboo. The partial fractures are due to the fibrous nature of the bamboo and the manner in which the cane is forcibly converted from tubular to sheet form. Notwithstanding those fractures, the sheet 2A is essentially one-piece.

Still referring to FIG. 5, each of the sheets 2A is subjected to a planing operation (by running them through a powered planing machine, not shown) whereby the inner and outer skins of the bamboo cane, i.e., the upper and lower surfaces of the sheet 2A, are removed so as to produce a flat sheet with a uniform thickness.

Figure 6:
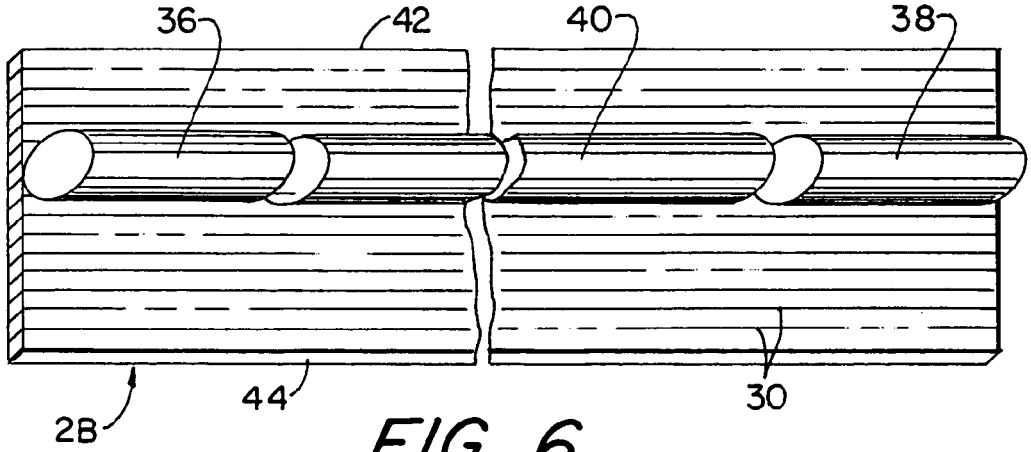
FIG. 6 illustrates how wood dowels and core members are assembled with the bamboo sheet.

Thereafter the planed sheet is cut and trimmed to provide one or more narrower sheets in the form of elongate strips 2B (FIG. 6), with each strip having a desired length and a width calculated to produce a finished laminated pole of desired outside diameter. Depending on the original size of the cane from which it was produced, the width of sheet 2A the sheet may be such that two or more strips of desired width can be produced by slitting the sheet lengthwise.

Referring again to FIG. 1, each elongate strip 2B is dried, ready for the laminating process. The process of producing a laminated pole according to this invention comprises coating one surface of each strip 2B with a suitable adhesive resin that is cured by heat. In this connection it is to be noted that planing the inner and outer surfaces of the sheet 2A has the advantage of facilitating permeation of the bamboo strips 2B by an adhesive resin. The composition of the adhesive resin is not critical to the invention and the invention may be practiced using a variety of conventional and commercially available adhesive resins that are compounded for use in laminating wood components to other wood or plastic components.

Figure 7:
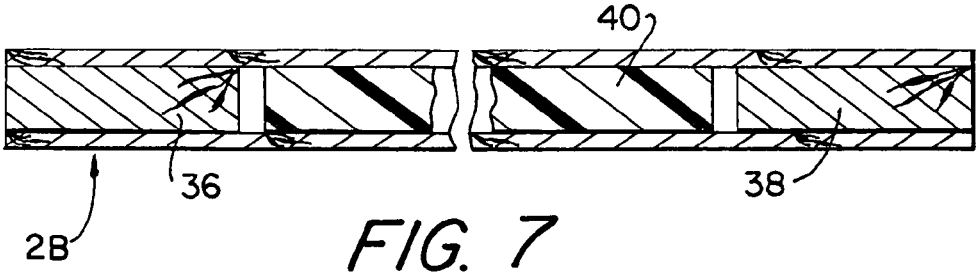
FIG. 7 is a sectional view in side elevation of a laminated pole formed in accordance with the invention.

The formation of a laminated pole is accomplished by associating with each strip 2B a plurality of reinforcing components. In the preferred embodiment of the invention, these reinforcing components comprise a pair of wood dowels 36 and 38 and a core member 40. These components are placed on the adhesive-coated surface of the strip 2B. The dowels are oriented so that their axes extend parallel to the longitudinal axis of the strip 2B, with the dowels being placed at opposite ends of the strip. The core member 40 is located between and may or may not contact the two dowels. Preferably core member 40 extends close to but does not contact the dowels. In this connection it is to be noted that the core member 40 may consist of one elongate member or two or more elongate members disposed in touching or axially-spaced relation with one another. The core member may be made of wood. However, in a preferred embodiment of the invention, the core member 40 is made of a plastic material. That plastic material may be of a thermoplastic or thermosetting form. The choice of plastic is not critical to the invention. The strip 2B is wound around dowel members 36 and 38 and core member 40, with the opposite edges 42 and 44 of strip 2B abutting one another and with the resulting assembly 48 being as shown in longitudinal section in FIG. 7.

Figure 8:
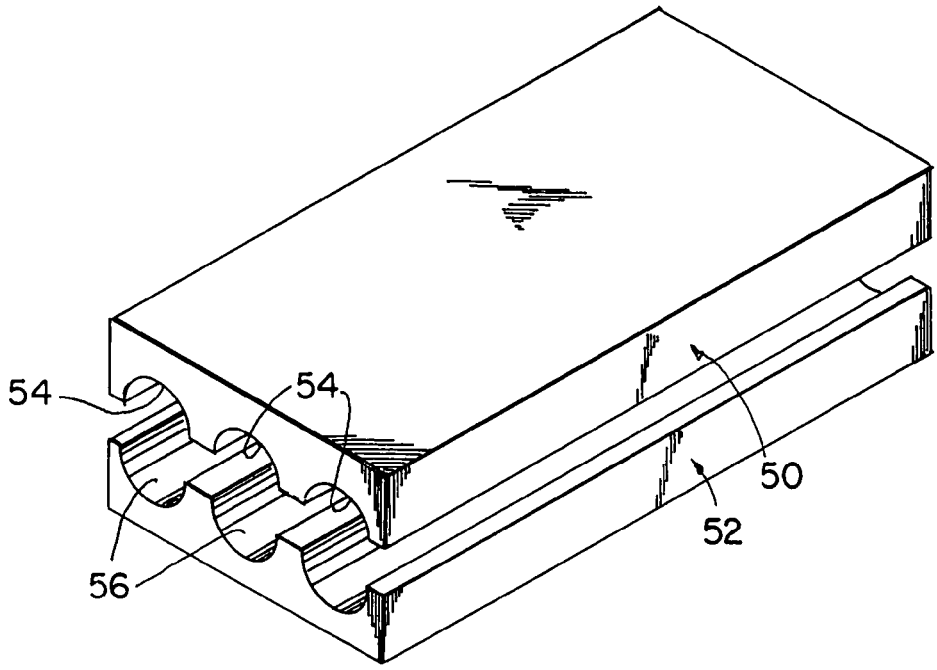
FIG. 8 is a schematic representation of the curing mold used to form multiple laminated poles like that shown in FIG. 7.

A plurality of the assemblies 48 are positioned within a laminating mold where they are subjected to heat and pressure. FIG. 8 illustrates the two parts 50 and 52 of a laminating mold. Parts 50 and 52 are formed with a like number of elongate semicircular grooves 54 and 56, respectively with each pair of grooves 54 and 56 being sized to form a cylindrical mold cavity for receiving one of the assemblies 48. Although not shown, it is to be understood that the two mold parts 50 and 52 are provided with heating means whereby when the mold is closed the assemblies 48 can be heated to a temperature sufficient to cause the thermosetting resin in each assembly to penetrate the wood dowels 36 and 38 and also wet plastic core member 40. The assemblies 48 are maintained in the mold long enough for the adhesive resin to set and cure, thereby forming an integral structure in the form of an elongate pole with a generally round outer surface.

Figure 9:
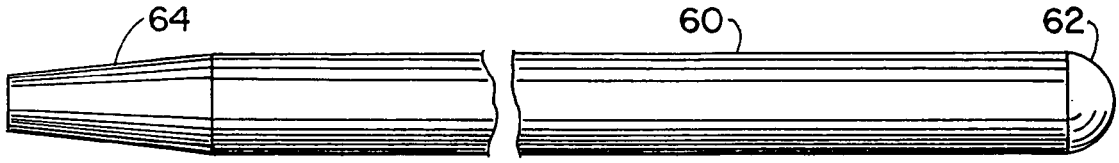
FIG. 9 illustrates a finished handle.

These elongate poles are removed from the mold and then are subjected to a turning operation to provide a cylindrical pole with a selected outer diameter. The turning operation is conducted using a lathe and/or other suitable machine. These poles may be sold as is. Alternatively the turning operation may include modifying the ends of the pole to provide a handle of selected configuration. FIG. 9 shows a finished handle 60 made in accordance with the invention. In this case the pole has been provided with a tapered front end 64 for attachment to a tool head, e.g., a mop, brush, or rake head, and its back end 62 has been rounded off for an aesthetic appearance. Preferably the turning that provides the tapered front end 64 is conducted such as to remove both the bamboo wrapping and a portion of the dowel 36. Although not shown, it is contemplated that the front end 64 may be provided with a screw thread if the pole is to be used as a handle with a tool head that has a threaded hole for receiving a handle.

The following example is provided to assure a full understanding of the invention (in considering this example it is to be understood that the various dimensions are by way of example and not limitation). In this example, the object is to provide a pole having a finished diameter of 28 mm and a selected length. To achieve this, the inner and outer skins of a sheet 2A of green bamboo cane are removed by planning to achieve a uniform thickness in the range of about 4.5 mm to about 8.0 mm. Then the smooth sheet is cut to provide at least one strip having width in the range of about 100 mm to about 103 mm. After drying, that strip is coated with adhesive resin and combined with a plastic core and wood dowels as described above to form an assembly as illustrated in FIG. 7 having an outside diameter of about 32 mm. That assembly and other like assemblies are placed into a laminating mold having semicircular grooves 54 and 56 that together form a cavity with a diameter of 30 mm. Those assemblies are placed in the grooves (54 or 56) of one half of the mold and then two mold halves are brought together under pressure to compress those assemblies to a diameter of 30 mm. The assemblies are subjected to heat and are kept in the mold long enough for the adhesive resin to set and cure, whereby each assembly is converted to an elongate generally round laminated pole structure having a diameter of about 30 mm. After removal from the mold each pole is turned to a uniform diameter of about 28 mm. The poles are made in selected lengths according to customer requirements, e.g., a length of about 119 cm (i.e., 47 inches).

Further by way of example, if it is desired to produce a pole having a diameter of 25.4 mm, the planed bamboo cane sheets are cut into strips having a width of about 81 mm to about 83 mm, and those strips are combined with a plastic core and wood dowels and molded as described above to form a pole having a diameter of about 27 mm. That assembly is turned to a final diameter of diameter of 25.4 mm The primary advantage of the method of this invention is that, in comparison with the prior art method of making laminated bamboo handles using a plurality of dried bamboo strips cut to a particular shape, requires less labor fewer operations, with the result being a substantial reduction in the cost of producing wooden handles made of bamboo. This new method also results in less waste material. In practice it has been determined that the process of the present invention saves about 20% in materials and at least about 10% in labor over the prior method of making laminated bamboo handles of the type herein described.

A further advantage of the invention is that it is susceptible of modifications. Thus, for example, the core member 40 may be made of wood and the adhesive resin may be applied to the dowels and the core members in addition to or in place of coating one side of the bamboo strips. A further advantage occurs where the sheet 2A (after being planed to a uniform thickness) may be wide enough to make one strip 2B of desired width and a second strip of inadequate width. Instead of being discarded as waste, that second strip may be combined with one or more other undersized strips in side by side relationship, two dowels and a core member to make a laminated pole according to this invention as herein described. Although the invention contemplates curing more than one assembly of bamboo strip, wood dowels and core member in a laminating press, the laminating process also may be practiced so as to make only one laminated pole at a time. However, that approach is not preferred since it is less efficient and hence more costly. The invention also may be practiced by drying the bamboo sheets after they have been planed but before they are cut to provide the strips 2B. However, drying the strips 2B is preferred for ease of handling and efficiency. It is contemplated also that one or both of the dowels may be made of some material other than wood and that the back end dowel 62 may be replaced by a plastic dowel. Another possible embodiment consists of replacing the two dowels and the core member with a single solid member made of wood that extends for the full length of the laminated pole.

Other modifications and advantages of the invention will be obvious to persons skilled in the art.

What is claimed is:

1. A method of making an elongate laminated pole for use as a handle for mops, floor and wall brushes and rakes, the method comprising:

(a) splitting a green bamboo cane lengthwise along a single cut line and then spreading the split bamboo cane so that it forms a substantially flat sheet;

(b) planing the opposite sides of said sheet so as to give it a substantially uniform thickness, (c) cutting the bamboo sheet to form a narrower sheet of selected width;

(d) drying the narrower sheet;

(e) providing an assembly comprising a pair of dowels, at least one elongate core member, said elongate strip, and an adhesive, with said narrower sheet wrapped around the dowels and the at least one core member and the adhesive disposed between said narrower sheet and the dowels and core member;

(f) subjecting said assembly to heat and pressure so as to cause the adhesive to set and bond the dowels and core member to the surrounding narrower sheet and thereby form an elongate laminated pole; and (g) turning the elongate laminated pole to a selected outer diameter.

2. Method according to claim 1 wherein a plurality of said assemblies are subjected to heat and pressure simultaneously to as to provide a plurality of elongate laminated poles.

3. Method according to claim 1 wherein said core member is made of plastic.

4. Method according to claim 1 wherein said turning is conducted so as that one end of laminated pole is tapered.

5. Method according to claim 1 wherein said turning is conducted so as to expose at least a portion of one of said dowels at said tapered end.

6. Method according to claim 1 wherein said adhesive is applied as a coating to said narrower sheet.

7. An elongate laminated pole for use as a handle for mops, floor and wall brushes and rakes made by the method of:

(a) splitting a green bamboo cane lengthwise along a single cut line and then spreading the split bamboo cane so that it forms a substantially flat sheet;

(b) planing the opposite sides of said sheet so as to give it a substantially uniform thickness, (c) cutting the bamboo sheet to form a narrower sheet of selected width;

(d) drying the narrower sheet;

(e) providing an assembly comprising a pair of wooden dowels, at least one elongate core member, said elongate strip, and an adhesive, with said narrower sheet wrapped around the dowels and the at least one core member and the adhesive disposed between said narrower sheet and the dowels and core member;

(f) bonding the dowels and core member to the surrounding narrower sheet, thereby forming an elongate laminated pole; and (g) turning the elongate laminated pole to a selected outer diameter.

8. An elongate laminated pole in accordance with claim 7 wherein said core member is of a selected one of wood and plastic.

9. The elongate laminated pole of claim 7 wherein the bonding comprises subjecting said assembly to heat and pressure so as to cause the adhesive to set and bond the dowels and core member to the surrounding narrower sheet.

* * * * *